US007648098B2

(12) United States Patent
Goeking et al.

(10) Patent No.: US 7,648,098 B2
(45) **Date of Patent: *Jan. 19, 2010**

(54) LOW RESERVE INDICATOR FOR A PAPER TOWEL DISPENSER

(75) Inventors: Harold J. Goeking, Oshkosh, WI (US); Gregory D. Budz, Sobieski, WI (US); Michael R. Kilgore, Little Suamico, WI (US); Karl D. Kissinger, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/923,960

(22) Filed: Oct. 25, 2007

(65) Prior Publication Data

US 2008/0073456 A1 Mar. 27, 2008

Related U.S. Application Data

(60) Continuation-in-part of application No. 11/066,135, filed on Feb. 23, 2005, now Pat. No. 7,434,760, which is a division of application No. 10/359,168, filed on Feb. 6, 2003, now Pat. No. 6,908,059, which is a continuation-in-part of application No. 09/713,317, filed on Nov. 16, 2000, now Pat. No. 6,517,025.

(51) Int. Cl.
*B65H 26/00* (2006.01)

(52) U.S. Cl. ..... 242/563; 242/593; 242/912

(58) Field of Classification Search ..... 242/563, 242/563.2, 590, 593, 912; 221/6; 116/243; 312/234

See application file for complete search history.

(56) References Cited

U.S. PATENT DOCUMENTS

| | | | |
|---|---|---|---|
| 1,738,721 | A | 12/1929 | Morin |
| 2,601,956 | A | 7/1952 | Birr |
| 3,260,402 | A | 7/1966 | Lareau et al. |
| 3,273,773 | A | 9/1966 | Eder |
| 3,292,170 | A | 12/1966 | D'Angelo |
| 4,204,180 | A | 5/1980 | Usui et al. |
| 4,566,581 | A | 1/1986 | Martin |
| 4,756,485 | A | 7/1988 | Bastian et al. |
| 4,760,970 | A | 8/1988 | Larsson et al. |
| 5,236,348 | A | 8/1993 | Fetherolf et al. |
| 5,765,718 | A | 6/1998 | Grasso et al. |
| 5,884,861 | A | 3/1999 | Hosomi et al. |
| 6,089,499 | A | 7/2000 | Robinson |

(Continued)

FOREIGN PATENT DOCUMENTS

| | | | |
|---|---|---|---|
| DE | 4225164 | A1 | 2/1994 |

(Continued)

*Primary Examiner*—William A Rivera
(74) *Attorney, Agent, or Firm*—Joel T. Charlton

(57) ABSTRACT

A low reserve indicator mechanism for a supply of paper towels is disclosed. The mechanism includes a base, a pushplate, and an indicator. The pushplate is connected to the base with a translational degree of freedom therebetween, is biased in a first direction relative to the base, and is responsive to a first attribute of the supply of paper towels to translate opposite the first direction. The indicator is pivotally connected to the pushplate, and is movable between a retracted position and an indicating position in response to a second attribute of the supply of paper towels.

25 Claims, 12 Drawing Sheets

U.S. PATENT DOCUMENTS

| | | | | |
|---|---|---|---|---|
| 6,267,321 | B1 | 7/2001 | Tramontina | |
| 6,321,963 | B1 | 11/2001 | Gracyalny et al. | |
| 6,328,252 | B1 | 12/2001 | Neveu et al. | |
| 6,517,025 | B1 * | 2/2003 | Budz | 242/563 |
| 6,695,247 | B2 | 2/2004 | Widlund | |
| 6,908,059 | B2 * | 6/2005 | Budz et al. | 242/563 |
| 7,434,760 | B2 * | 10/2008 | Budz et al. | 242/563 |
| 2002/0113162 | A1 | 8/2002 | Fournier et al. | |
| 2004/0035976 | A1 | 2/2004 | Byrd et al. | |
| 2005/0139718 | A1 * | 6/2005 | Budz et al. | 242/563.2 |

FOREIGN PATENT DOCUMENTS

| | | | |
|---|---|---|---|
| EP | 0836825 | A1 | 4/1998 |

* cited by examiner

LOW RESERVE INDICATOR FOR A PAPER TOWEL DISPENSER

CROSS REFERENCE TO RELATED APPLICATIONS

This application is a continuation-in-part of U.S. application Ser. No. 11/066,135, filed Feb. 23, 2005, which is a divisional of U.S. Pat. No. 6,908,059, filed Feb. 6, 2003, which is a continuation-in-part of U.S. Pat. No. 6,517,025, filed Nov. 16, 2000. The disclosure of each aforementioned priority document is incorporated herein by reference in their entirety.

BACKGROUND OF THE INVENTION

It is conventional to dispense paper towels from an upright roll, that is, a roll whose center axis is oriented vertically. The center of the roll is coreless, so the paper can be pulled from the inner periphery of the roll, that is, usually downwardly through a hole formed in a floor of a dispenser housing. Therefore, the radial thickness of the roll gradually diminishes from a roll inner periphery toward a roll outer periphery. Eventually, only a very small radial thickness of the roll remains.

It is also conventional to dispense paper towels from a vertical stack of individual towels or from a horizontal roll that rotates about a horizontal axis.

It is desirable for the user to be informed when the paper reserve is low in dispensers of the above-described types.

Low-reserve indicators have been previously proposed for paper towel dispensers of the type wherein individual towels are arranged in a vertical stack (see U.S. Pat. No. 1,738,721), or in a horizontal roll (see U.S. Pat. Nos. 2,601,956 and 3,273,773). In U.S. Pat. No. 1,738,721, the low reserve indicator includes a follower roller which rests upon the top of the stack and travels downwardly as the stack is depleted. The roller is attached by a lever arm to a pointer which is visible through a window disposed in a upper portion of the dispenser housing. The pointer rotates as the roller descends, in order to traverse a space between an "empty" indicia and a "full" indicia. Shortcomings of such an indicator include the fact that the roller must be manually held in a raised state by an operator who is loading fresh towels in the dispenser, thus complicating the re-filling operation. Also, the lever must be relatively long in order to extend between the pointer and the roller when the roller is at its lowermost state, whereby the expense, weight, size etc. of the indicator are greater than would be desired.

In each of U.S. Pat. Nos. 2,601,956 and 3,273,773, a relatively long indicator arm must be provided in order to extend to an outer cylindrical periphery of a paper roll U.S. Pat. No. 2,601,956, or in order to extend along and past the entire longitudinal length of the paper roll U.S. Pat. No. 3,273,773. Such long elements increase the overall cost of providing a low reserve indicator mechanism.

Also, it will be appreciated that the low reserve indicators described above are not suitable to a vertically oriented roll, let alone a coreless roll whose towels are pulled from the inner periphery of the roll.

BRIEF DESCRIPTION OF THE INVENTION

An embodiment of the invention is directed to a low reserve indicator mechanism for a supply of paper towels. The mechanism includes a base, a pushplate, and an indicator. The pushplate is connected to the base with a translational degree of freedom therebetween, is biased in a first direction relative to the base, and is responsive to a first attribute of the supply of paper towels to translate opposite the first direction. The indicator is pivotally connected to the pushplate, and is movable between a retracted position and an indicating position in response to a second attribute of the supply of paper towels.

Another embodiment of the invention is directed to a dispenser for a supply of paper towels. The dispenser includes a housing, and the aforementioned low reserve indicator mechanism having a base, a pushplate and an indicator. The housing includes a first section movably affixed to a second section, where the first section and the second section define an inner chamber and a dispensing aperture. The base of the low reserve indicator mechanism is attached to at least one of the first section and the second section.

A further embodiment of the invention is directed to a low reserve indicator mechanism for a supply of paper towels. The mechanism includes a base, an indicator, a release arm, and a pushplate. The indicator is coupled to the base with a first translational degree of freedom and a first rotational degree of freedom therebetween. The release arm is coupled to the base with a second translational degree of freedom and a second rotational degree of freedom therebetween. The pushplate is coupled to the base with a third translational degree of freedom therebetween. The first, second and third translational degrees of freedom are coincidental, and the first rotational degree of freedom and the second rotational degree of freedom are coupled such that rotation of the release arm causes rotation of the indicator.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

Figure 1:
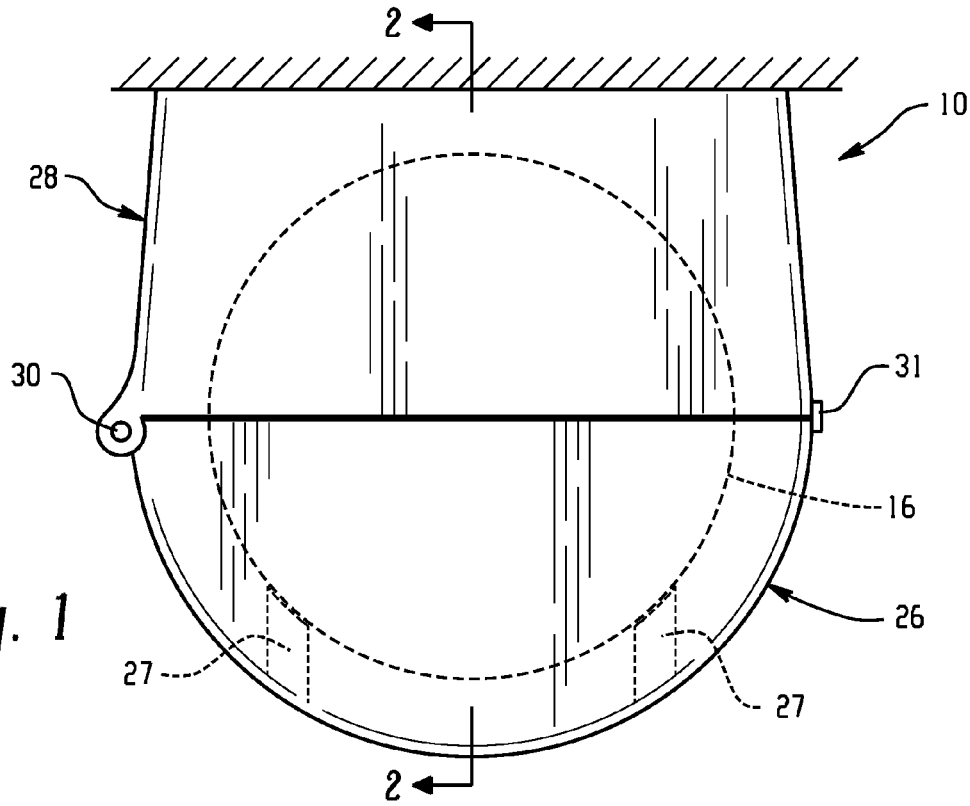
FIG. 1 is a plan view of a dispenser.
Figure 2:
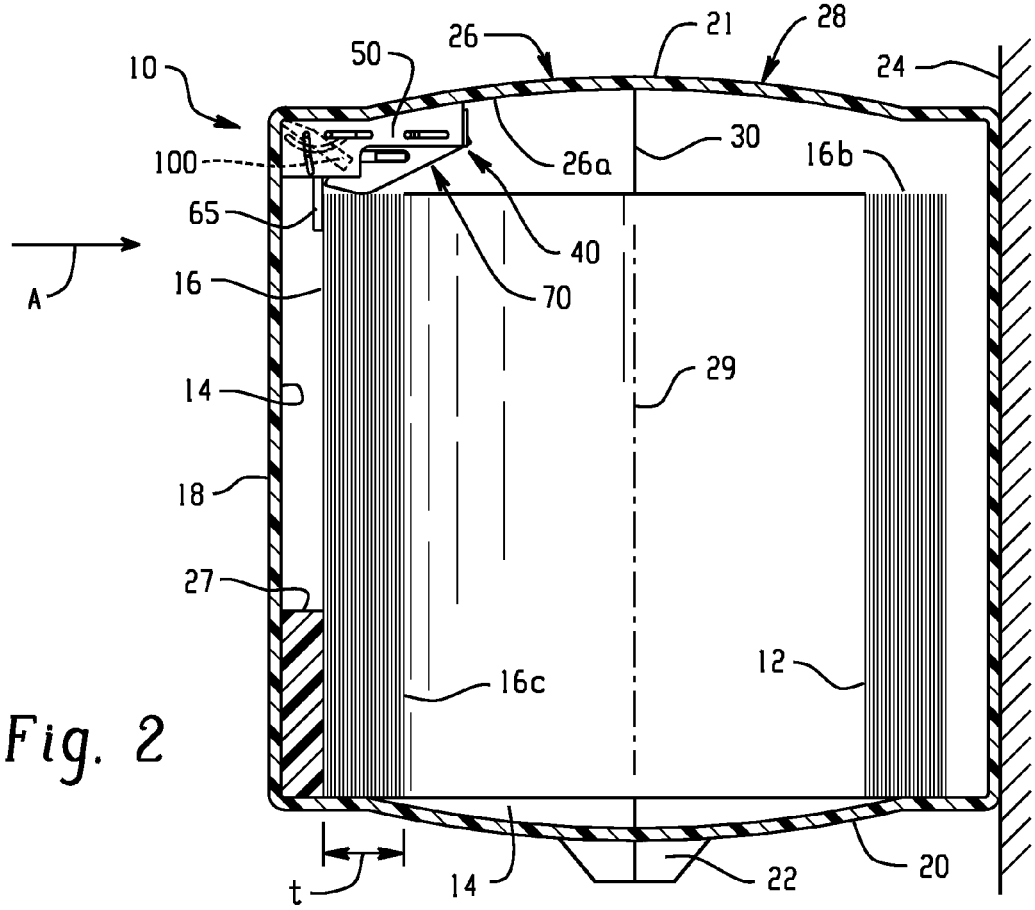
FIG. 2 is a vertical sectional view taken along line 2-2 in FIG. 1, depicting an upright coreless roll of paper towels disposed within the dispenser, and a low-reserve indicating mechanism according to the present invention.
Figure 3:
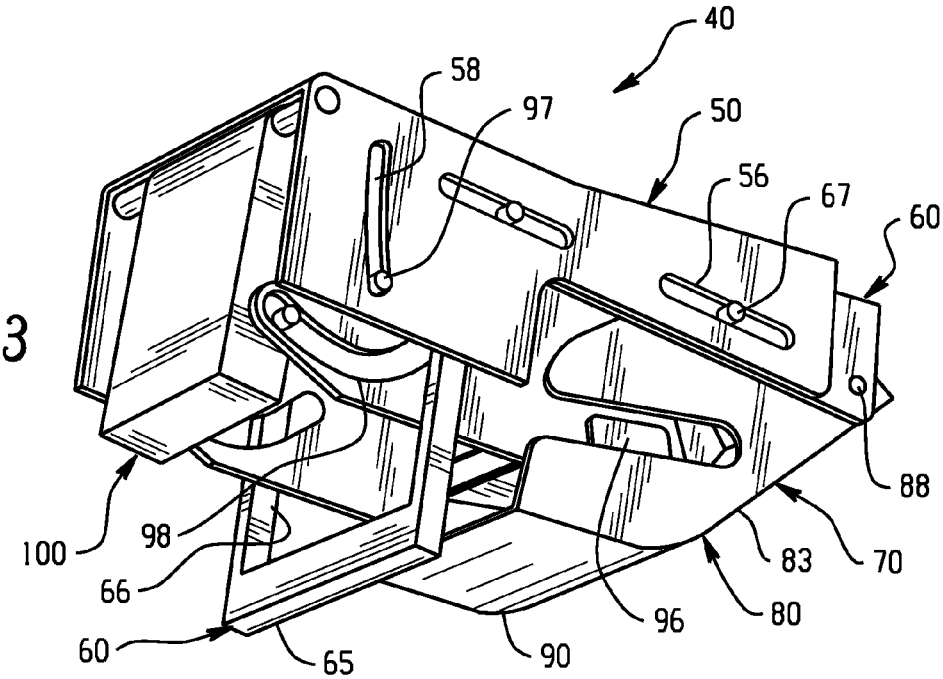
FIG. 3 is a bottom front perspective view of a low reserve indicator mechanism according to the present invention.
Figure 4:
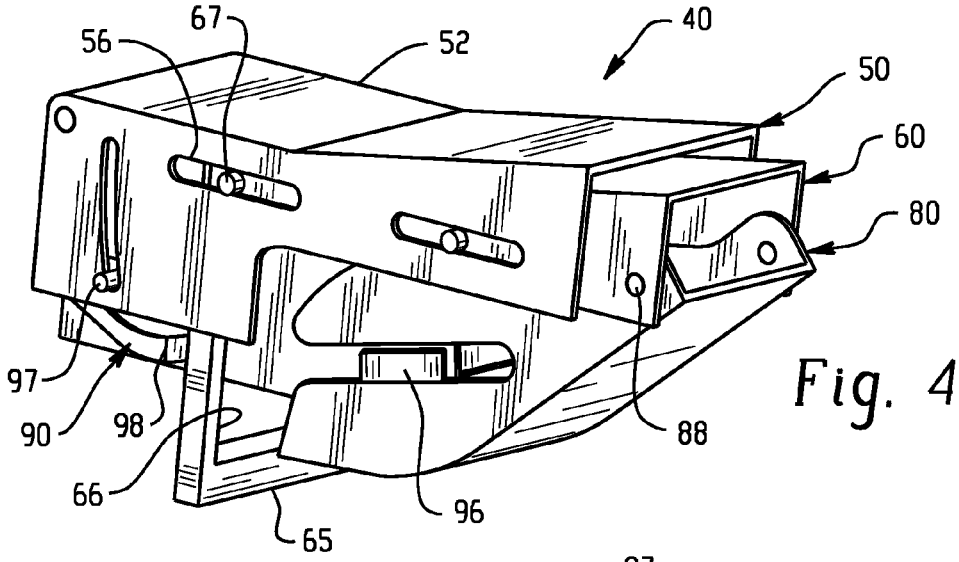
FIG. 4 is a rear top perspective view of the indicator mechanism depicted in FIG. 3.
Figure 5:
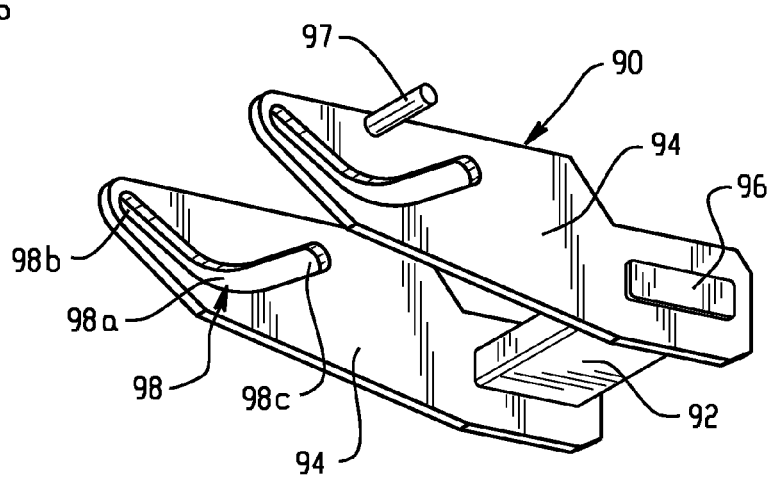
FIG. 5 is a bottom front perspective view of a release portion of a release mechanism according to the present invention.

Depicted in FIGS. 1 and 2 is a paper towel dispenser 10 which dispenses towels from a paper supply in the form of a coreless roll 16 of paper towels from an inner periphery 12 of the roll 16. The dispenser housing includes an upright side wall 18, a floor 20, and a cover 21, together forming an internal chamber 14 for housing the roll 16. The floor 20 includes a central opening 22 through which the towels can be dispensed.

A rear side of the dispenser is to be affixed to a wall 24, so that the central opening 22 is spaced from the wall. In a conventional manner, the dispenser 10 is split into front and rear sections 26, 28 about a vertical parting line, and the dispenser is hinged at 30 along a vertical side of the parting line, to enable the generally semi-cylindrically shaped front section 26 to be swung open about that hinge, whereby the roll 16 can be inserted. Afterwards, the centermost towel is pulled partially down through the opening, and the front section 26 is closed, whereupon the dispenser is ready to dispense. A releasable latch 31 of any suitable type is provided for securing the front and rear sections 26, 28 in a closed state. In an embodiment, the front section 26 includes a guide, such as ribs 27. The ribs 27 are disposed to centrally position a supply of paper towels by contacting the outer diameter of the roll 16 and positioning a center 29 of the roll 16 relative to the central opening 22 following closure of the front section 26 onto the rear section 28.

As the roll 16 becomes depleted, its radial thickness t becomes gradually diminished. In order to warn a user or custodian when the remaining number of towels in the roll reaches a low state, a low-reserve indicator 40 (also herein referred to as a "low reserve indicator mechanism") is provided.

Figure 6:
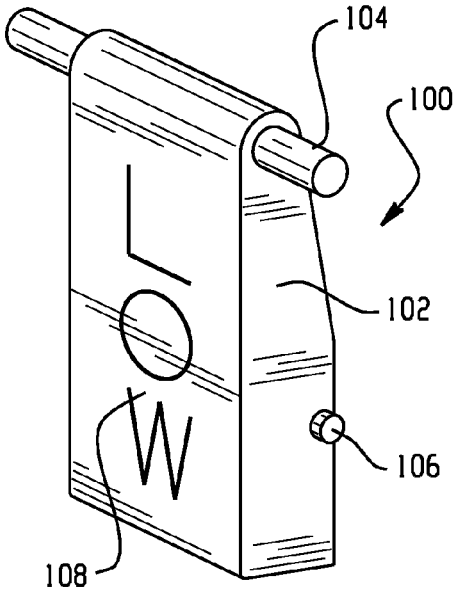
FIG. 6 is a front perspective view of an indicator sign of the indicator mechanism.
Figure 7:
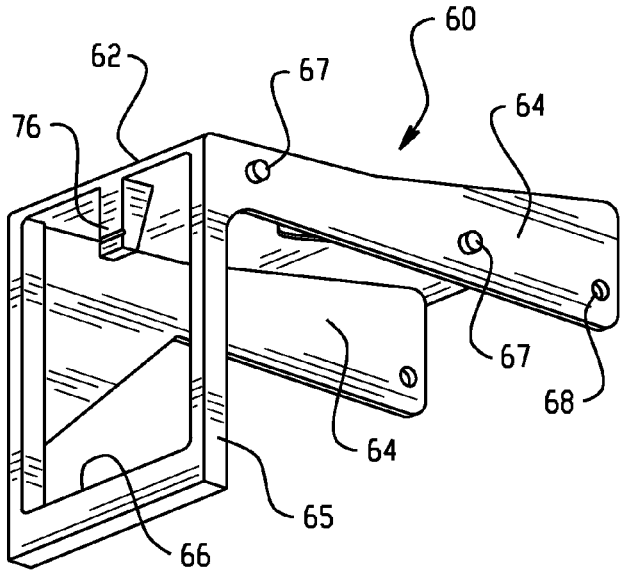
FIG. 7 is a front bottom perspective view of a pusher member of the indicator mechanism.
Figure 8:
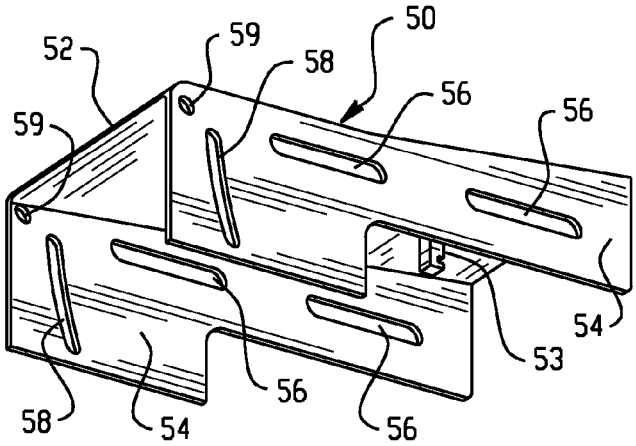
FIG. 8 is a front bottom perspective view of a base member of the indicator mechanism.
Figure 9:
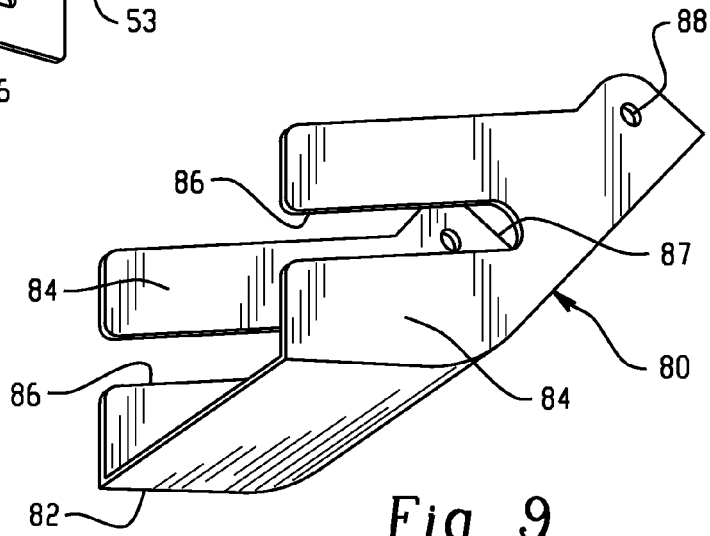
FIG. 9 is a front bottom perspective view of a supporting portion of a release mechanism of the indicator of mechanism.

A first embodiment of the indicator 40, depicted in FIGS. 2-11, comprises an upper housing 50 (FIG. 8), a pusher member 60 (FIG. 7), a release mechanism 70 including a release arm 80 (FIG. 9) and a release slide 90 (FIG. 5), and an indicator in the form of a sign 100 (FIG. 6).

Figure 13:
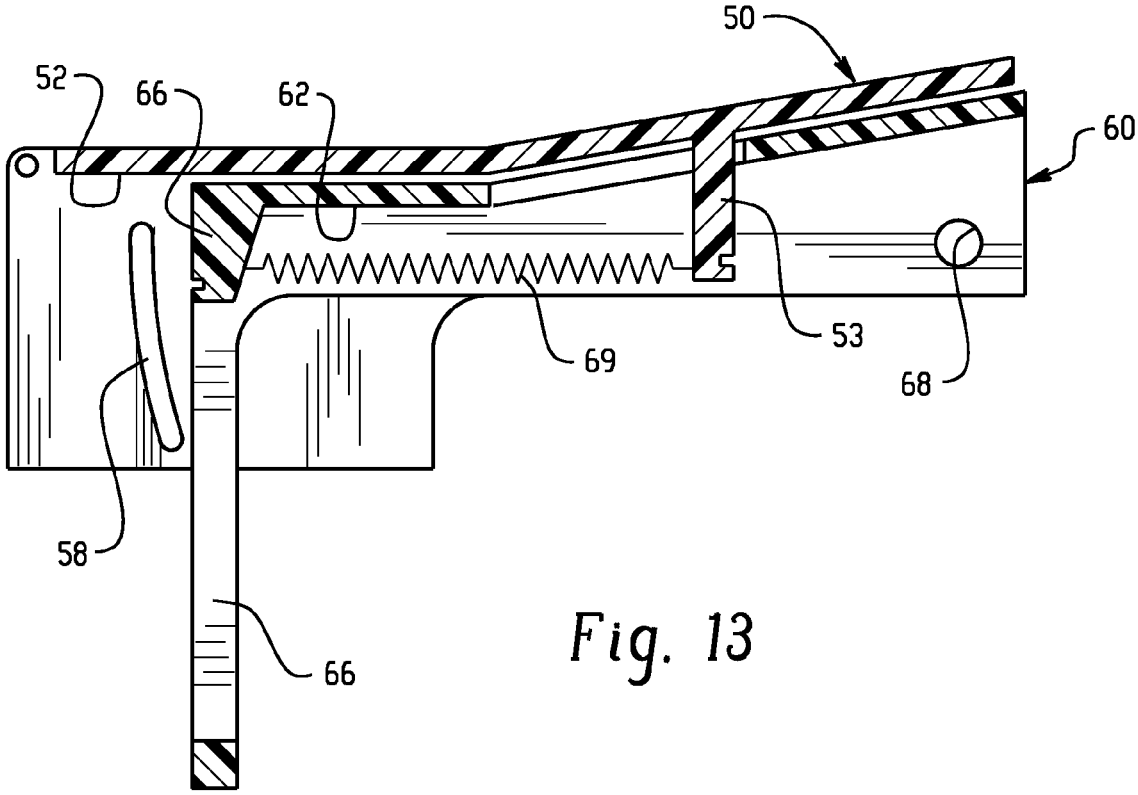
FIG. 13 is a sectional view taken through two components of the low reserve indicator mechanism.

The upper housing or base 50 (FIG. 8) is adapted to be fixed to an underside 26*a* of the dispenser, for example, by a double-backed adhesive (not shown) which can be attached to a top wall 52 of the upper housing 50. Depending downwardly from the top wall 52 are two identical parallel side walls 54, each including a pair of horizontal guide slots 56, a curved, generally vertical guide slot 58, and a pivot hole 59. The guide slots 56 and 58 of each side wall 54 are horizontally aligned with respective slots of the other side wall 54. Also depending from the top wall 52 is a leg 53 adapted to support a rear end of a coil spring 69 (FIG. 13), as will be discussed.

The pusher member 60 (FIG. 7) includes a top wall 62 disposed beneath the top wall 52 of the upper housing 50, a pair of side walls 64 disposed parallel to, and inside of, the side walls 54 of the upper housing, and a front pusher arm or wall 65 depending downwardly from a front end of the top wall 62 and side walls 64. The pusher arm 65 includes an aperture 66 for accommodating movement of the sign 100, as will be explained. Projecting outwardly from the exterior surface of each of the side walls 64 are two guide pins 67. Those guide pins 67 are slidably received in respective horizontal guide slots 56 of the upper housing 50 to define a pin-and-slot connection to enable the pusher member to slide relative to the base. A pivot hole 68 is situated at a rear end of each side wall 64 to support the release arm 80 of the release mechanism 70. Depending downwardly from a front end of the top wall 62 is a leg 76 that supports a front end of the spring 69. It will be appreciated that the spring 69 yieldably biases the pusher member toward the center of the housing for reasons to be explained.

The release arm 80 (FIG. 9) includes a bottom wall 82 and two side walls 84 extending upwardly from the bottom wall 82. The bottom wall 82 includes a rearwardly facing portion 83 which extends generally upwardly and rearwardly to enable the release arm to be cammed upwardly upon engaging a roll of paper towels when the dispenser is closed, as will be explained. Each side wall 84 includes a guide slot 86 extending in a generally front-to-rear direction. A front end of each guide slot 86 is open, whereas a rear end 87 thereof is closed. Each side wall 84 includes a hole 88 aligned with the respective pivot hole 68 of the pusher member 60, whereby an axle 89 (FIG. 12) can be inserted through the holes 68, 88 to establish a pivot connection enabling the release arm 80 to pivot up and down. The front end of the release arm 80 is thus able to move up and down. One or more torsion springs 91 (see FIG. 12) are provided at the axle 89 to yieldably bias the release arm for counter-clockwise rotation as viewed in FIG. 12.

The release slide 90 (FIG. 5) includes side walls 94 and a connector 92 interconnecting rear ends of the side walls 94. Projecting outwardly from a rear end of each side wall 94 is a guide projection in the form of a rectangular-shaped pin or lug 96 that is slidably disposed in the respective slot 86 of the release arm 80 to define therewith a pin-and-slot connection. A projection in the form of a guide pin 97 projects laterally outwardly from each side wall 94 at a location forwardly of the guide pin 96. The guide pins 97 extend through respective guide slots 58 of the upper housing 50 to define therewith a pin-and-slot connection. Formed in the side wall 94 forwardly of the guide pin 97 is a slot 98 of generally U-shape.

The slot 98 includes a central apex portion 98*a* and front and rear portions 98*b*, 98*c* extending generally upwardly from the apex portion.

Figure 10:
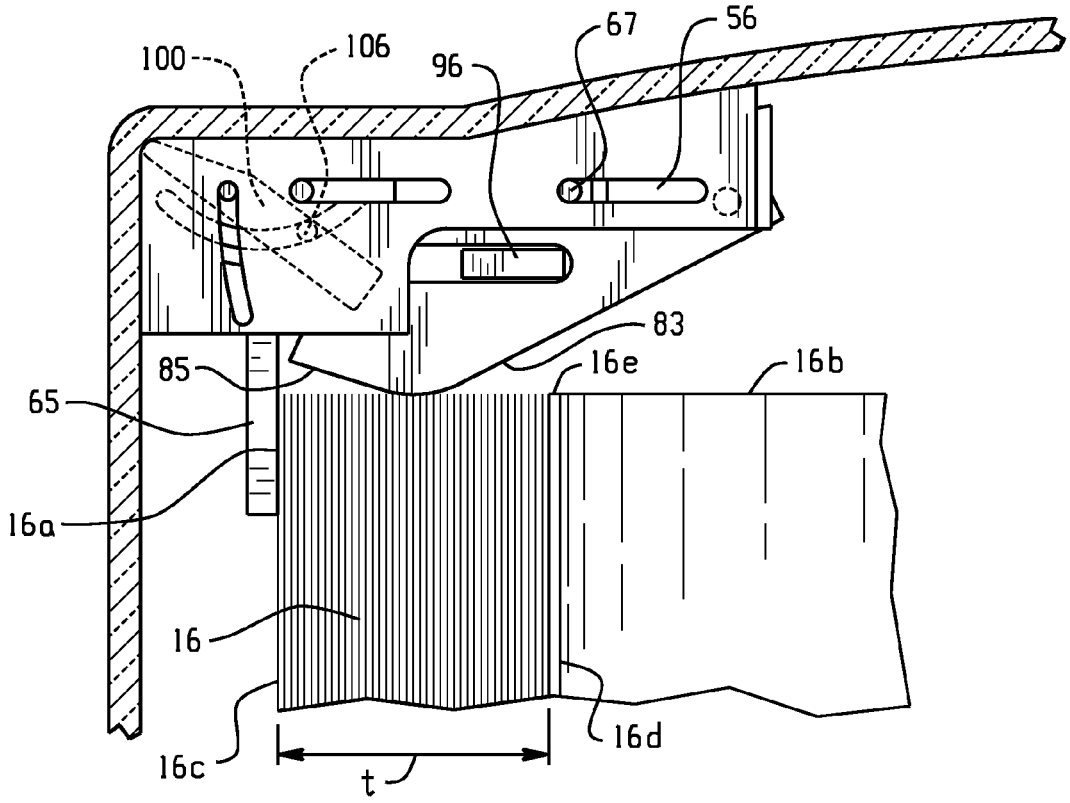
FIG. 10 is a fragmentary vertical sectional view taken through the dispenser of FIG. 1 with the indicator mechanism associated with a first roll of paper towels.
Figure 11:
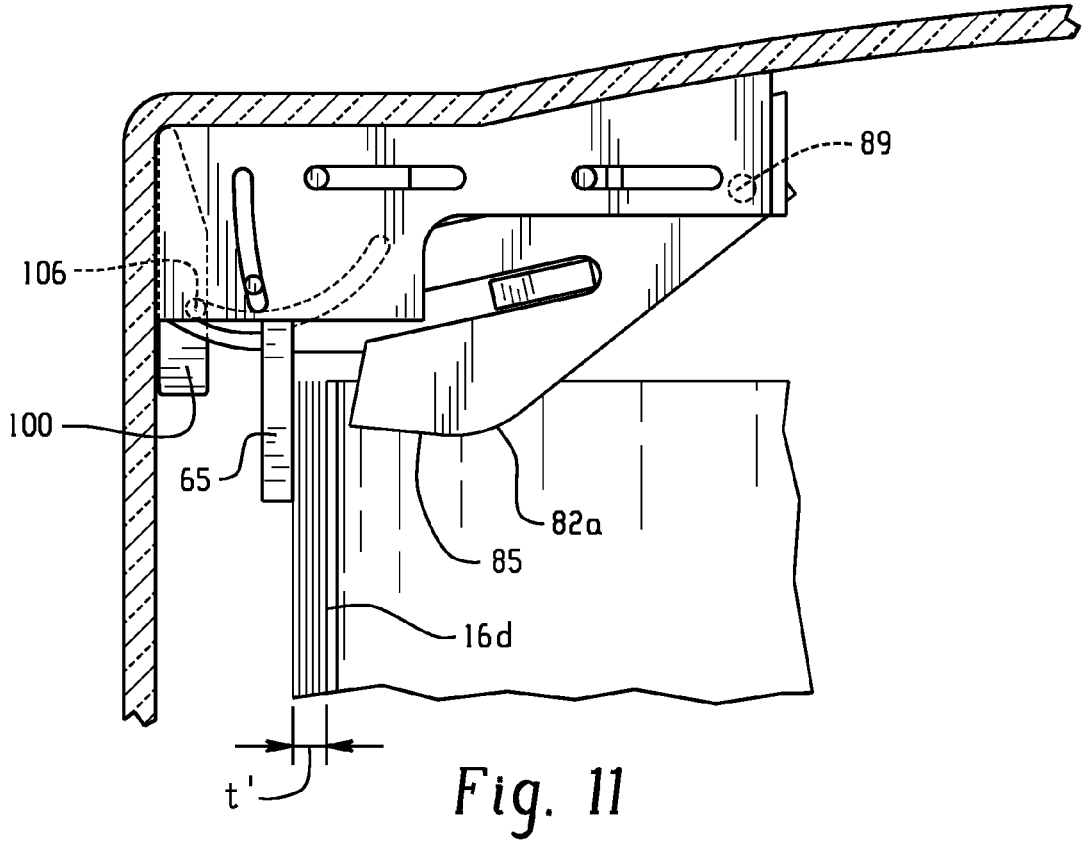
FIG. 11 is a view similar to FIG. 10 after the indicator mechanism has indicated that the remaining quantity of towels in the roll is low.
Figure 14:
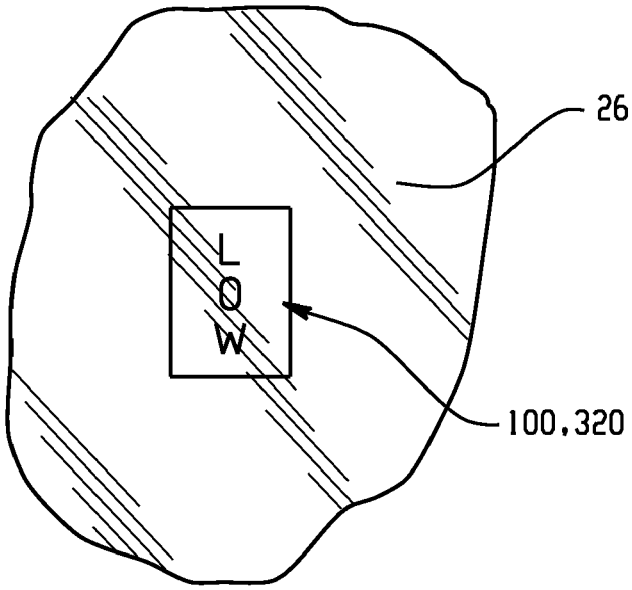
FIG. 14 is a fragmentary view of a sidewall of the dispenser taken in the direction of arrow A in FIG. 2, when the low reserve indicator mechanism indicates that the remaining quantity of paper towels on the roll is low.

The sign 100 (FIG. 6) includes a body 102 having a pair of laterally projecting pivot pins 104 mounted in respective ones of the pivot holes 59 of the upper housing to enable the sign 100 to swing between a rear (retracted) position (FIG. 10) and a forward or indicating (extended) position (FIG. 11). The sign also carries pins 106 disposed in the slots 98 to form therewith a pin-and-slot connection. A front face 108 of the sign 100 carries indicia, such as the word "LOW" which is visible to a user or custodian when the sign is in the forward position (see FIG. 14).

To enable the indicia to be visible, the front section 26 of the dispenser housing is preferably formed of a transparent material, such as a tinted acrylic. Alternatively, a window could be formed in the front section 26 through which the indicia could be seen.

In operation, the coreless roll 16 of paper towels is mounted in an upright state within the internal chamber 14 of the dispenser. When the front section 26 of the dispenser is then closed, the indicating mechanism (which is fixed to the underside 26*a* of the front section 26 of the dispenser) approaches cylindrical outer periphery of the roll 16. In this state, the pusher member 60 will be in its right-most position, that is, closest to the center of the dispenser, under the urging of the spring 69 (see FIG. 13). Also, the release arm 80 will be in its lowermost position, due to gravity; aided by the force of the torsion spring 91 (see FIG. 12). As a result, the inclined rearwardly facing portion 83 of the bottom wall of the release arm 80 of the release mechanism 70 abuts an upper edge 16*a* of the roll 16 and is cammed upwardly thereby. Hence, the release arm 80 is caused to pivot upwardly against the bias of the torsion springs 91 about a pivot axis defined by the axle 89. Eventually, the release arm 80 comes to rest on an upper surface 16*b* of the roll 16, as shown in FIG. 10.

It will be appreciated that the release mechanism accommodates rolls of varying height (that is, longitudinal length), because of the ability of the release arm 80 to pivot upwardly. That is, the extent to which the release arm swings upwardly will be dependent upon the height of the roll 16. The greater the roll height, the greater will be the distance by which the release arm 80 swings upwardly.

When the front pusher arm 65 of the pusher member 60 abuts an outer periphery 16*c* of the roll 16 it may be pushed radially outwardly thereby, against the bias of the spring 69 (see FIG. 13), by a distance dependent upon the diameter of the roll 16. In the embodiment according to FIGS. 10-11, the roll 16 of maximum diameter has been installed, whereby the pusher member 60 has been displaced to its maximum outer position wherein the guide pins 67 of the pusher member 60 are disposed at the front end of the guide slots 56 of the base.

Figure 12:
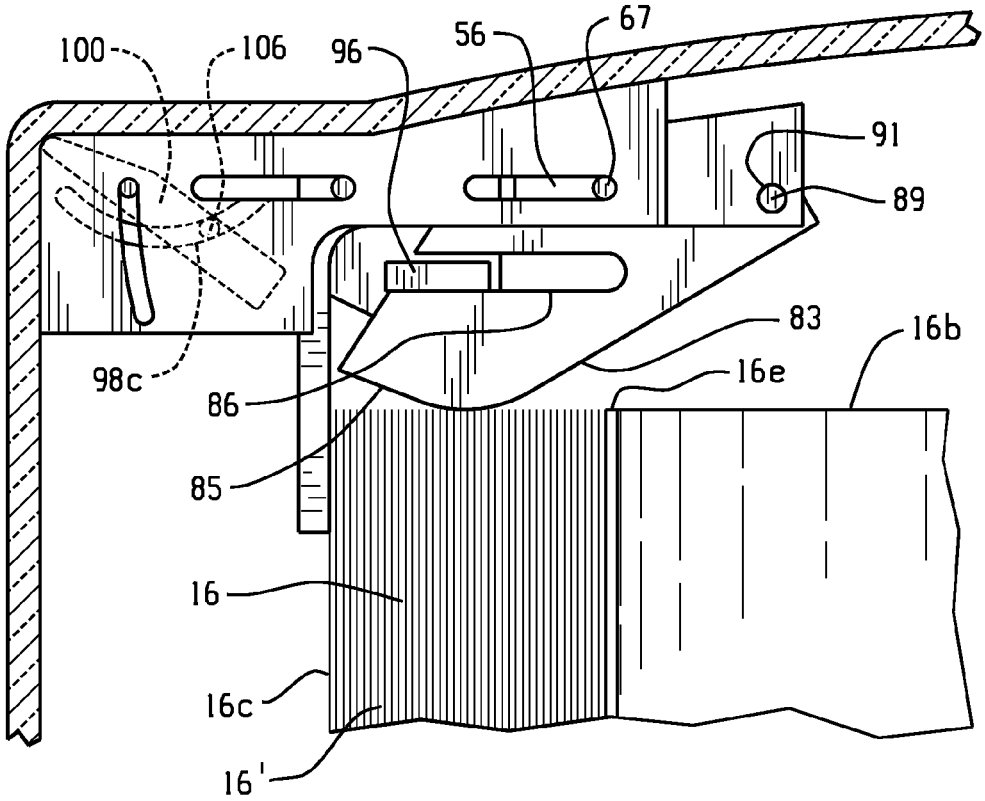
FIG. 12 is a view similar to FIG. 10 wherein the dispenser contains a roll of paper towels having a smaller outer diameter than the roll of FIG. 10.

If the roll 16 had been of a smaller outer diameter, as depicted in FIG. 12 wherein a smaller diameter roll 16' has been installed, the pusher member 60 (FIG. 3) would not have been displaced radially outwardly (that is, to the left) as far as in FIGS. 10 and 11. Also, the guide pins 96 of the release slide 90 would be situated farther outwardly (to the left) in the guide slots 86 of the release arm 80 in FIG. 12. Thus, the reason for making the release mechanism 70 of two parts 80 and 90 is to enable rolls of different outer diameter to be accommodated.

In any event, it will be appreciated that since the release arm 80 is mounted on the pusher member 60, the final position of that release arm 80 is dependent upon the final position of the pusher member 60.

In the state shown in FIG. 10, the guide pins 106 of the sign are captured in the rear portion 98*c* of the guide slots of the release slide 90, and the sign 100 is held in the rear (retracted) position.

As towels are removed from an inner periphery 16*d* of the roll, the radial thickness t of the roll diminishes. Eventually, the inner periphery reaches a lowermost portion 82*a* of the bottom wall 82 of the release arm 80, whereafter an inclined, forwardly facing portion 85 of the release arm 80 contacts an upper rear edge 16*e* of the release arm 80. Eventually, the thickness t' is so thin, for example, one-eighth of an inch, that the upper edge 16*a* of the roll travels radially outside of a front end of the forwardly facing portion 85. Accordingly, the release arm becomes unsupported and drops downwardly about the axis of the pivot pins, due to gravity (see FIG. 11). As that happens, the release slide 90 swings downwardly with the release arm, whereupon the guide slots 98 force the guide pins 106 of the sign 100 forwardly until the sign comes to rest in the forward position, so that the user or custodian can see the "LOW' indicia (see FIG. 14).

It will be understood that since the release arm 80 is mounted on the pusher member 60 and moves together therewith, the distance between the pusher arm 65 and the roll-contacting point on the bottom wall 82 of the release arm 80 will remain essentially constant during the towel dispensing phase, regardless of the horizontal location of the pusher member 60, that is, regardless of the outer diameter of the roll. Thus, the sign 100 will always provide a low reserve indication in response to the same value of t'.

It will be appreciated that the low-reserve mechanism according to the present invention enables a user or custodian to be warned of a low-reserve state of an upright roll of paper towels in a dispenser. Furthermore, the low-reserve mechanism automatically adjusts to the height and outer diameter of the upright roll.

Also while it has been mentioned that springs can be provided to bias the release arm 80 downwardly, it may be possible to dispense with those springs and rely upon gravity alone if the design is such that insufficient friction will be generated that could cause the release arm to become hung-up.

Figure 15:
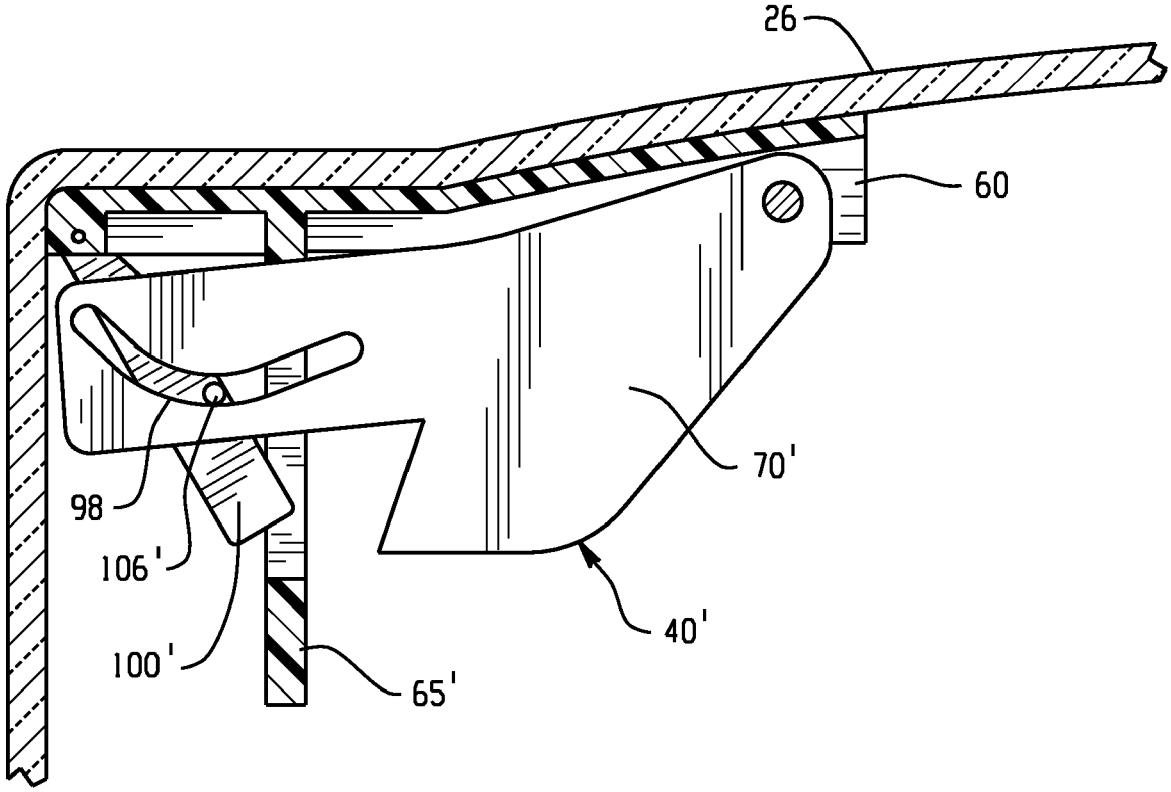
FIG. 15 is a view similar to FIG. 10 showing an alternative form of indicator mechanism.

It will also be appreciated that the feature of the invention wherein the low-reserve mechanism automatically adjusts to the roll diameter is optional. That is, the release mechanism, instead of being formed of two relatively movable parts 80, 90, could be formed of a single member, as shown in FIG. 15. That is, FIG. 15 shows an indicating mechanism 40' wherein the release mechanism 70' comprises a single element pivotably connected to a stationary upper housing 50' which also carries a pusher member 65' that abuts the outer periphery of the roll 16. A release mechanism 70' carries guide slots 98' in which guide pins 106' of the sign 100' slide. The indicator mechanism accommodates a roll of a given outer diameter and does not possess the ability to accommodate rolls of different outer diameter as does the mechanism of FIGS. 1-14.

Figure 16:
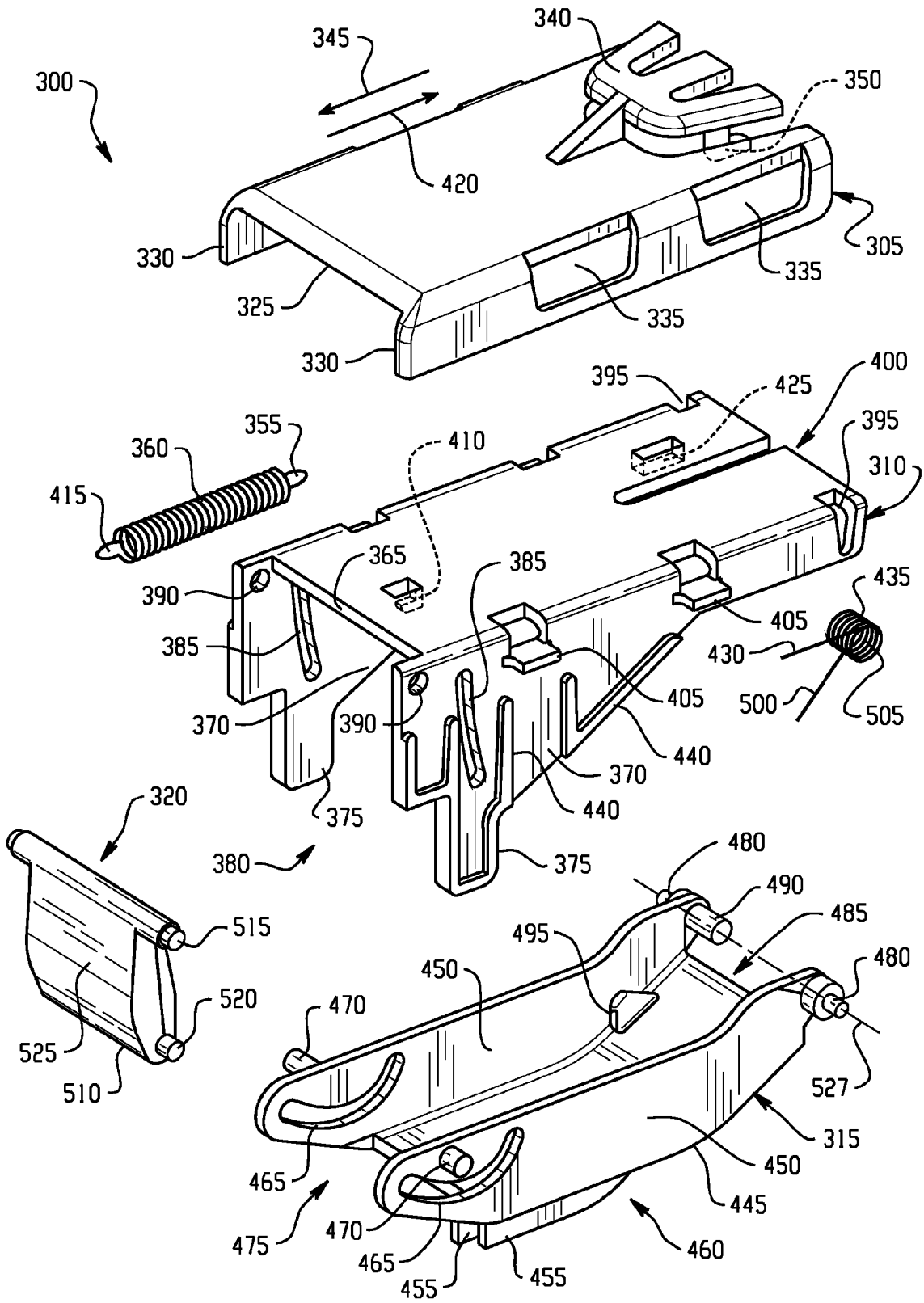
FIG. 16 is an exploded assembly view showing an alternative form of the indicator mechanism in accordance with an embodiment of the invention.

FIG. 16 depicts an exploded assembly perspective view of an alternate embodiment of the low reserve indicator 40, such as a low reserve indicator 300. The low reserve indicator 300 includes construction similar to the mechanism 40' of FIG. 15, as well as the feature to automatically adjust to the roll 16 diameter while providing an enhanced reliability, as will be described further below. The low reserve indicator 300 includes an upper housing (alternatively referred to as a base) 305 (FIG. 17), a pushplate 310, a release arm 315 (FIG. 17), and a sign 320.

In an embodiment, the upper housing or base 305 is fixed to the underside 26*a* of the dispenser 10 via a double-backed adhesive (not shown) attached to the top wall 52 of the upper housing 50. In another embodiment, the base 305 includes an attachment feature 340 adapted for attaching the base 305 to the dispenser 10. For example, the attachment feature 340 may engage with complementary geometry 342 (FIG. 17) of the underside 26*a* of the dispenser 10 (best seen with reference to FIGS. 17-19), such as by translation of the base 305 in a forwardly direction 345 subsequent to disposing the attachment feature 340 adjacent with the complementary geometry 342. Depending downwardly from a top wall 325 of base 305 are two parallel side walls 330, each including guide slots 335. Also depending downwardly from the top wall 325, (depicted integral with the attachment feature 340) is a leg 350 adapted to support a rear end 355 of a coil spring 360, as will be discussed further below. From the foregoing, it will be appreciated that use of a double-backed adhesive to secure base 305 to dispenser 10 would negate the need for attachment feature 340 and complementary geometry 342.

The pushplate 310 is slidably connected to the base 305 in the manner described hereinafter. The pushplate 310 includes a top wall 365 disposed beneath the top wall 325 of the base 305, and a pair of side walls 370 disposed parallel to and inside of the side walls 330 of the base 305. Projecting outwardly from an exterior surface of each of the side walls 370 are guides 405. The guides 405 are slidably received in respective horizontal guide slots 335 of the base 305 to define a guide-and-slot connection, thereby providing a translational degree of freedom between the pushplate 310 and the base 305 to enable the pushplate 310 to slide relative to the base 305. The side walls 370 of pushplate 310 include projections 375 that extend downwardly, curved, generally vertical guide slots 385, and pivot holes 390, all disposed proximate a front end 380 of the pushplate 310. The sidewalls 370 further include pivot openings 395 situated at a rear end 400 to support the release arm 315. The slots 385, holes 390, and openings 395 of one side wall 370 are horizontally aligned with respective slots 385, holes 390, and openings 395 of the other side wall 370.

Depending downwardly proximate the front end 380 of the top wall 365 is a leg 410 that supports a front end 415 of the spring 360. It will be appreciated that the spring 360 yieldably biases the pushplate 310 in a rearward direction 420 relative to the base 305 for reasons to be explained below. A first boss 425 depending downwardly from the top wall 365 proximate the rear end 400 receives and retains a first end 430 of a torsion spring 435. In an embodiment, the side walls 370 include protrusions 440, such as ribs for example, to increase at least one of a strength and a rigidity of the side walls 370.

The release arm 315 includes two side walls 450 extending upwardly from a bottom wall 445, and one or more ribs 455 depending downwardly from the bottom wall 445. At least one of the bottom wall 445 and the ribs 455 includes a rearwardly facing portion 460 that extends generally upwardly and rearwardly to enable the release arm 315 to be cammed upwardly upon engaging a roll of paper towels when the dispenser 10 is closed, as will be explained in more detail below.

Each side wall 450 includes a curved guide slot 465 extending in a generally front-to-rear direction. Pins 470 disposed proximate a front end 475 of the release arm 315 extend outwardly from the side walls 450, and are disposed so as to be aligned with the guide slots 385 of the pushplate 310. Pins 480 disposed proximate a rear end 485 of the release arm 315 extend outwardly from the side walls 450, and are disposed so as to be aligned with the pivot openings 395 of the pushplate 310. Accordingly, subsequent to assembly of release arm 315 to pushplate 310, such as by positioning the pins 470, 480 of the release arm within the slots 385 and pivot openings 395, respectively, of the pushplate 310, the release arm 315 is pivotally connected to the pushplate 310. The front end 475 of the release arm 315 is thus able to move up and down, pivoting about the pins 480 in an arc having a range of motion defined by the slots 385 and pins 470. Accordingly, both a translational and rotational degree of freedom are provided between the base 305 and the release arm 315 via the pushplate 310.

An extension 490, such as a pin, extends inwardly from at least one side wall 450 of the release arm 315 for supporting the torsion spring 435 by placing a center 505 of torsion spring 435 over the extension 490. A second boss 495, disposed proximate the extension 490, depends upwardly from the interior bottom wall 445 of release arm 315 for receiving and retaining a second end 500 of the torsion spring 435. The torsion spring 435 is provided at the extension 490 to yieldably bias the release arm 315 downward, away from the pushplate 310, for counter-clockwise rotation of the release arm 315 (as viewed from the side perspective of FIG. 16).

Figure 17:
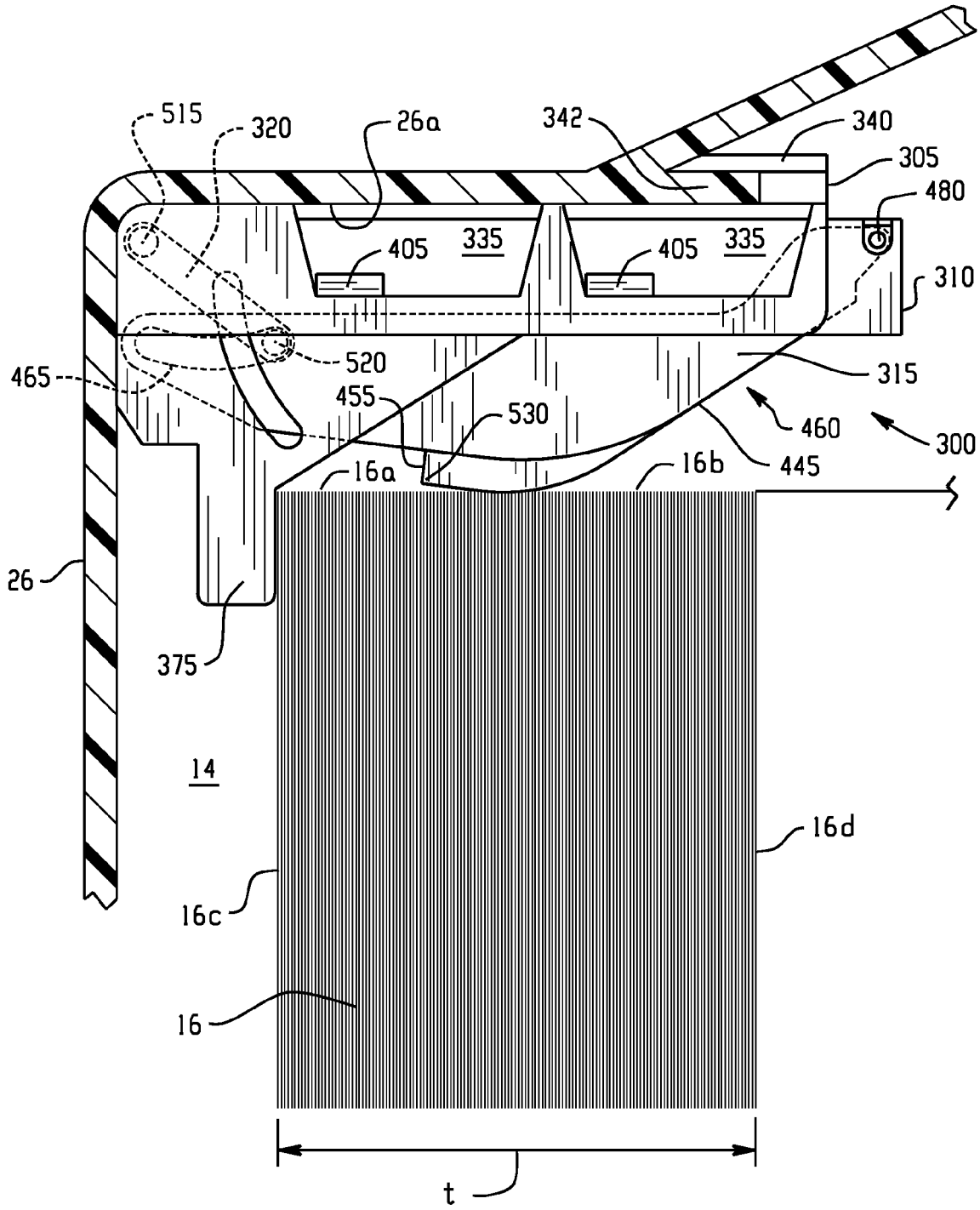
FIG. 17 is a fragmentary vertical sectional view taken through the dispenser of FIG. 1 with the indicator mechanism of FIG. 16 associated with a first roll of paper towels.
Figure 18:
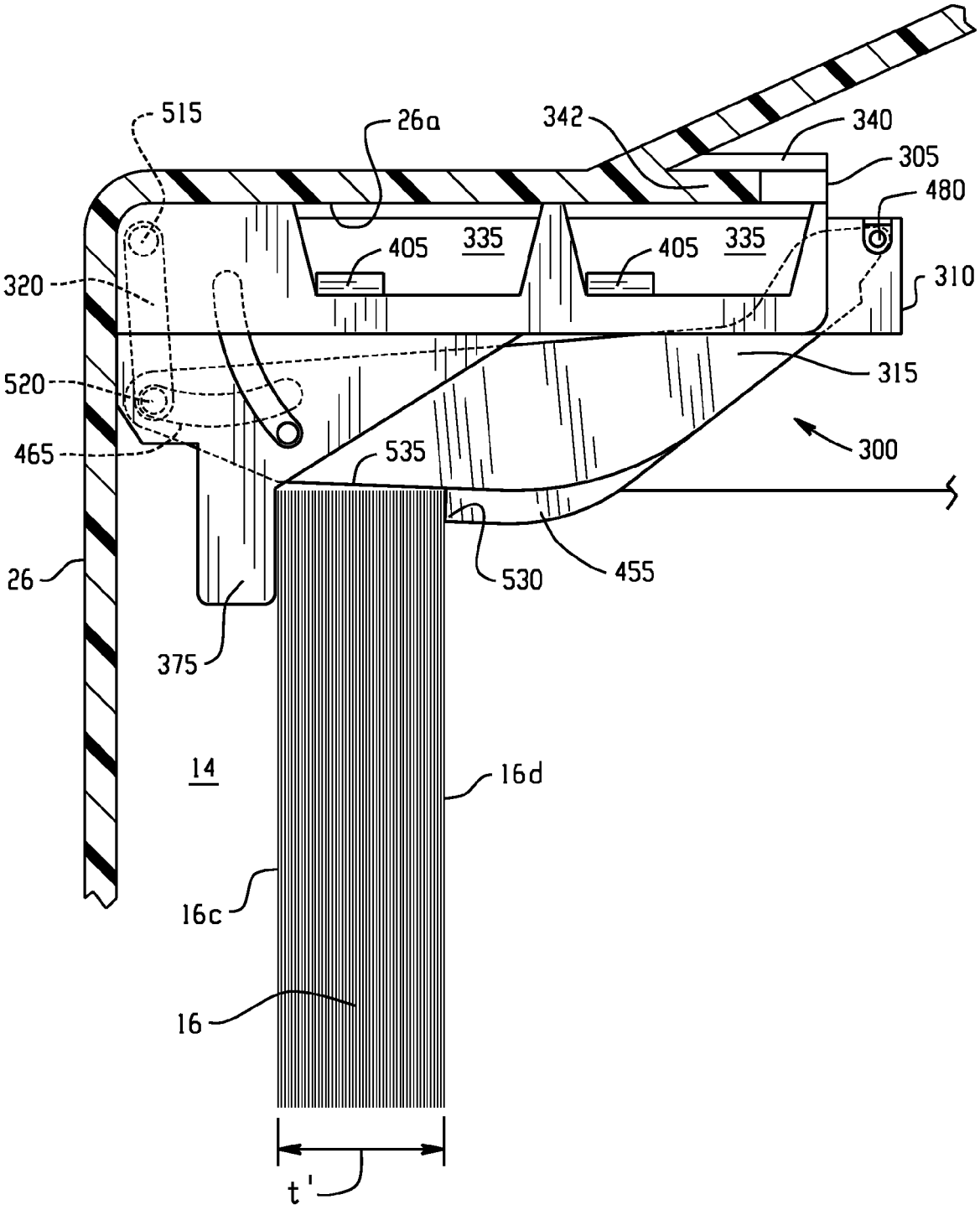
FIG. 18 is a view similar to FIG. 17 after the indicator mechanism has indicated that the remaining quantity of towels in the roll is low.

The sign 320 (also herein referred to as an "indicator") includes a body 510 that is pivotally connected to the pushplate 310 via a pair of laterally projecting pivot pins 515 mounted in respective ones of the pivot holes 390 of the pushplate 310. Accordingly, the sign 320 is capable of swinging between a rear (retracted) position (as depicted in FIG. 17) and a forward or indicating (extended) position (as depicted in FIG. 18). The sign 320 also includes pins 520 disposed in the slots 465 of the release arm 315 to form therewith a pin-and-slot connection such that the sign 320 is operably connected to the release arm 315. Viewed alternatively, slots 465 act as a cam, and pins 520 act as a cam follower, thereby defining the relative motion between sign 320 and release arm 315. A front face 525 of the sign 320 carries indicia, such as a readily observable color, or the word "LOW" for example, which is visible to a user or custodian when the sign 320 is in the indicating position.

The operation of the low reserve indicator 300 will now be explained with particular reference to FIGS. 17 and 18. In operation, the coreless roll 16 of paper towels is mounted in an upright state within the internal chamber 14 of the dispenser 10. As the front section 26 of the dispenser 10 is then closed, the low reserve indicator 300 (which is attached to the underside 26*a* of the front section 26 of the dispenser 10, via, for example, the attachment feature 340 and complementary geometry 342) approaches the cylindrical outer periphery 16*c* of the roll 16. In this state, (as the indicator 300 approaches the outer periphery 16*c*) the pushplate 310 will be in its right-most position, that is, closest to the center of the dispenser 10 under the bias force of the spring 360 (see FIG. 16). Also, the release arm 315 will be in its lowermost position, due to at least one of gravity and the bias force of the torsion spring 435. As a result of closure of the front section 26 of the dispenser 10, the inclined rearwardly facing portion 460 of the bottom wall 445 of the release arm 315 abuts the upper edge 16*a* of the roll 16 formed by superimposed edge portions of the roll 16, and is cammed upwardly thereby. Hence, the release arm 315 is caused to pivot upwardly (clockwise in FIGS. 17 and 18) against the bias of the torsion spring 435 about a pivot axis 527 (best seen with reference to FIG. 16) defined by the pins 480, to cause the sign 320 to move to the retracted position shown in FIG. 17. Eventually, the ribs 455 of the release arm 315 come to rest on the upper surface 16*b* of the roll 16.

While an embodiment has been described having the low reserve indicator 40 disposed upon the front section 26 of the dispenser 10, it will be appreciated that the scope of the invention is not so limited, and that the invention will also apply to dispensers 10 that include the low reserve indicator disposed upon the rear section 28 of the dispenser 10.

It will be appreciated that the release arm 315 accommodates rolls of varying height (that is, longitudinal length), because of the ability of the release arm 315 to pivot upwardly, and the extent to which the release arm 315 swings upwardly will be dependent upon the height of the roll 16. The greater the roll height, the greater will be the distance by which the release arm 315 swings upwardly.

The projections 375 on pushplate 310 are designed to contact an outer diameter of the roll 16, thereby being responsive to a first attribute (the outer diameter for example) of the roll 16 of paper towels. Subsequent to contact of the projections 375 of the pushplate 310 with the outer periphery 16*c* of the roll 16 in response to closure of the dispenser 10 by movement of the front section 26 toward the rear section 28, the projections 375 may be pushed radially outwardly (to the left of FIGS. 17 and 18) via the translational degree of freedom between the pushplate 310 and the base 305, against the bias of the spring 360, by a distance dependent upon the outer diameter of the roll 16. Use of the ribs 27 (as described in reference to FIG. 1) position the center 29 of the roll 16 within the internal chamber 14, such that the center 29 is disposed proximate the central opening 22, and a reliability of operation of the low reserve indicator 300 is enhanced, as will be described below. In the embodiment according to FIGS. 17-18, the roll 16 of maximum outer diameter has been installed, whereby the pushplate 310 has been displaced to its maximum outer position and the guides 405 of the pushplate 310 are disposed at the front end of the guide slots 335 of the base 305.

Figure 19:
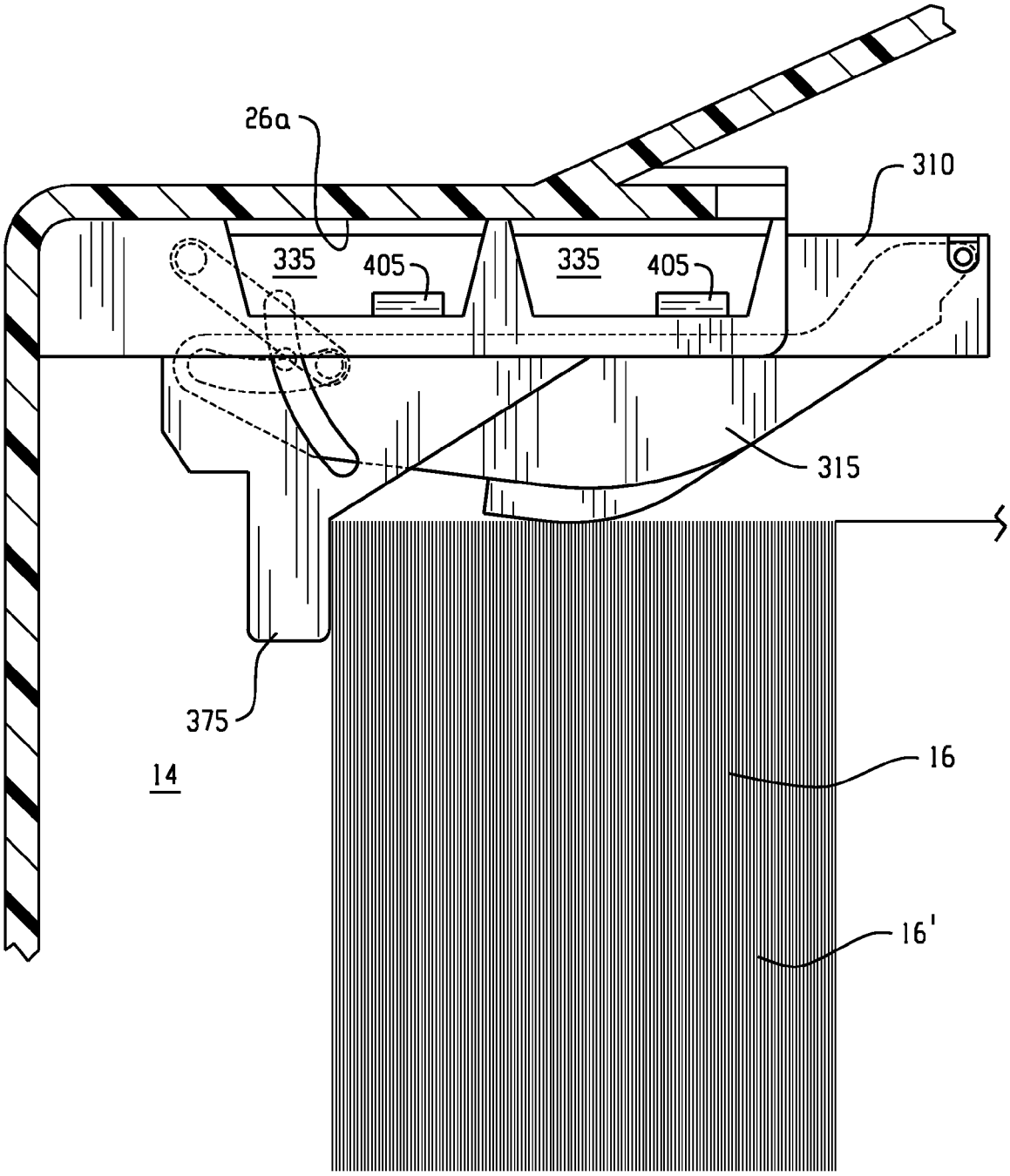
FIG. 19 is a view similar to FIG. 17 wherein the dispenser contains a roll of paper towels having a smaller outer diameter than the roll of FIG. 17.

In response to insertion of the roll 16 having a smaller outer diameter, as depicted in FIG. 19 wherein the smaller diameter roll 16' has been installed, the pushplate 310 (via projections 375) is not displaced radially outwardly (that is, to the left) as far as in FIGS. 17 and 18. Accordingly, the guides 405 of the pushplate 310 are situated farther inwardly (to the right) in the slots 335 of the base 305. In view of the foregoing, it will be appreciated that the relative motion between the pushplate 310 and the base 305 allows rolls 16 of different outer diameter to be accommodated.

The sign 320 is responsive to a second attribute of the roll 16 of paper towels, such as an edge feature (discussed in more detail below) of the roll 16 that exists at a defined location when a predetermined amount of the supply of paper towels remains in the roll 16. In the state shown in FIG. 17, the pins 520 of the sign 320 are captured in the rear portion of the curved guide slots 465 of the release arm 315, resulting in the sign 320 being pivoted in a counterclockwise direction about the pins 515 disposed within the pivot holes 390 of the pushplate 310 and being held in the rear (retracted) position.

As towels are removed from the inner periphery 16*d* of the roll 16, the radial thickness t of the roll 16 diminishes. Eventually, the inner periphery 16*d* reaches a lowermost portion 530 of at least one of the rib 455 and the bottom wall 445 of the release arm 315. Eventually, the thickness t' (as shown in FIG. 18) is reduced below the predetermined amount of the supply of paper towels, such as to one-eighth of an inch for example, and the inner periphery 16*d* of the roll 16 travels radially outside of the lowermost portion 530. In response to the radial travel of inner periphery 16*d* (the edge feature mentioned above), the release arm 315 becomes unsupported and drops downwardly (counterclockwise) about the pivot axis 527 defined by the pins 480, due to gravity and the downward bias of the torsion spring 435. In response to the downward drop of the release arm 315, the guide slots 465 force the pins 520 of the sign 320 forwardly until the sign comes to rest in the forward (indicating) position of FIG. 18, so that the user or custodian can see the indicia (see FIG. 14).

In view of the foregoing, it will be appreciated that the low reserve indicator 300 includes the sign 320 having a first, translational degree of freedom relative to the base 305, and a second, pivotal degree of freedom relative to the pushplate 310, and therefore, the base 305. Furthermore, the low reserve indicator 300, as depicted in FIGS. 16-19 represents an embodiment having fewer components than embodiments of the low reserve indicator 40 depicted in FIGS. 2-13, which thereby provides an overall cost savings. In addition to reducing the number of components, the two degrees of freedom of the sign 320 of the low reserve indicator 300 are functionally separate and therefore provide functional isolation between inter-connected components. For example, the function of accommodating towel rolls of various outer diameters is performed by translation of the pushplate 310 and sign 320 relative to the base 305, independent of any influence of the release arm 315 and sign 320 to indicate the low reserve of paper towels. In a similar fashion, the function of indicating the low reserve of paper towels is performed by rotation of the release arm 315 relative to the pushplate 310 to thereby cause the sign 320 to move to the indicating position, independent of any influence of the translation of the pushplate 310 relative to the base 305 to accommodate rolls 16 of various outer diameters.

In addition to reduced part count, the functional isolation between inter-connected components provides enhanced operational reliability, and use of the ribs 27 to position the center 29 of the roll 16 proximate the central opening 22 enhances an even distribution of force upon each of the projections 375, which reduces any unintended forces perpendicular to the forward 345 and rearward 420 directions that may result in jamming as the power towels are dispensed. Operational tests have shown that use of the low reserve indicator 300, as opposed to other indicators not having the functional isolation between inter-connected components disclosed herein, reduces occurrences of jamming, which result in inaccurate low reserve indication, from about 19% to almost 0%.

Figure 20:
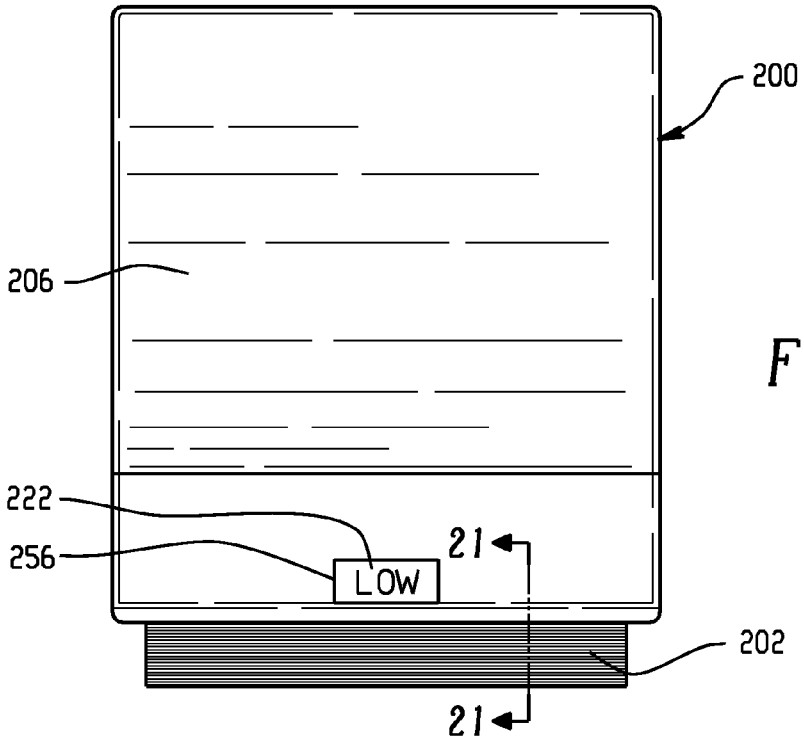
FIG. 20 is a front elevational view of a paper towel dispenser of the type which dispenses towels from a vertical stack, the dispenser containing a low reserve indicator according to the invention.
Figure 21:
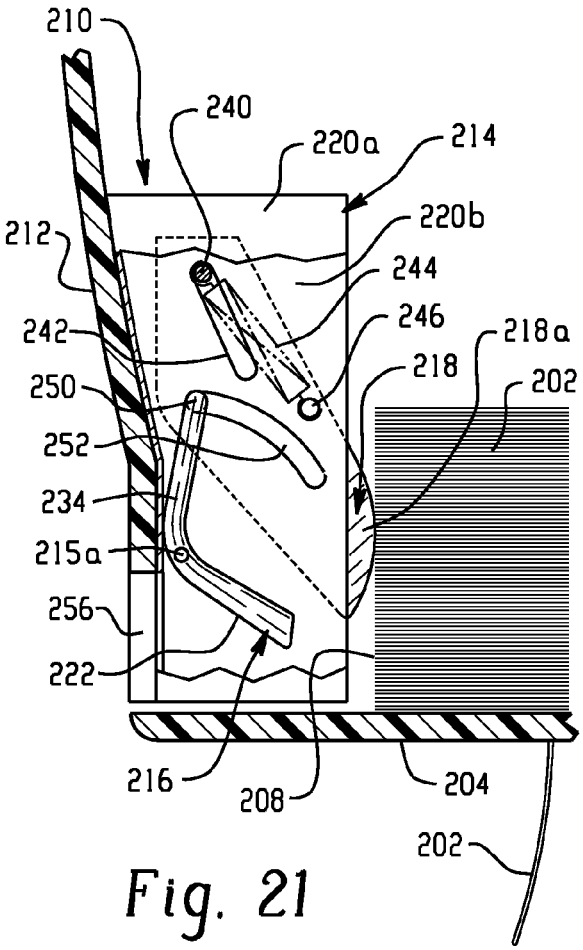
FIG. 21 is a sectional view taken along line 21-21 in FIG. 20 showing the low-reserve indicator in a retracted position.
Figure 22:
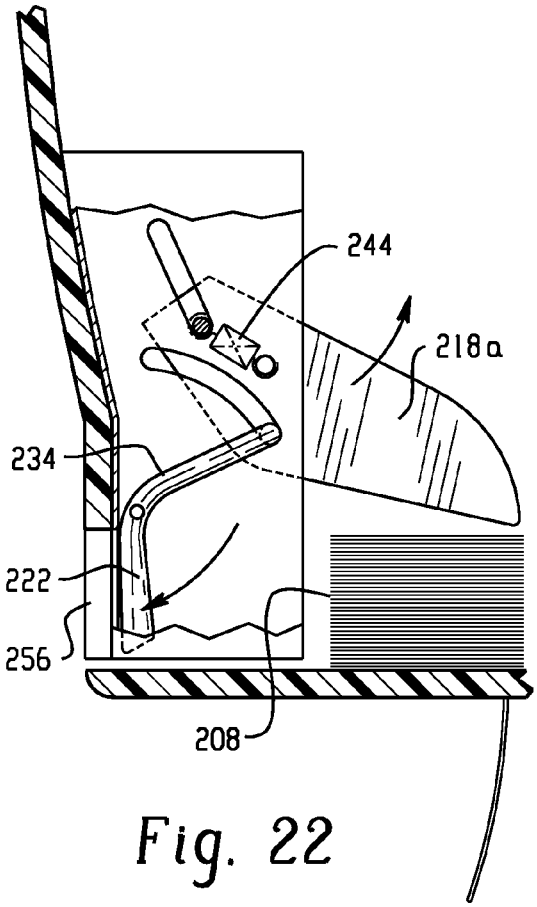
FIG. 22 is a view, similar to FIG. 21, after a release mechanism of the indicator has been released in response to the paper stack descending below a predetermined level.

Embodiments of the present invention can also be used to provide a low-reserve indication for towel dispensers of the type in which towels are dispensed from a paper supply in the form of a vertical stack or a horizontal roll. In that regard, attention is directed to FIGS. 20-22 depicting a dispenser housing 200 of the type which dispenses paper towels 202 disposed in a vertical stack. The dispenser includes a fixed first section 204 that is fixed to a wall (not shown), and a hinged second section (door) 206 that is connected to the first section 204 by a hinge (for example, along an upper edge or a vertical side edge) to open and close a chamber formed by the dispenser housing. The stack of towels 202 (preferably interfolded towels) is supported such that at each end of the stack, vertically superimposed edge portions of the towels form a vertical side 208 that faces in a horizontally outward direction. The housing also forms a dispensing aperture at a lower end of the chamber for dispensing towels one-at-a-time.

A low-reserve indicator mechanism 210 according to the invention is affixed within the chamber to an upright wall 212 defined by the door 206 for indicating when a remaining (reserve) quantity of towels in the stack is low. The indicator mechanism includes a base member 214 affixed to the upright wall 212, an indicator 216 mounted to the base member 214 for rotation about a horizontal axis 215*a*, and a release mechanism 218. The base member is similar to the previously described upper housing 50 in that it includes a pair of parallel side walls 220*a*, 220*b*. The indicator 216 includes a sign 222 that bears the indicia "LOW", and a crank arm 234. The release mechanism comprises pair of parallel arms 218*a* (only one arm being depicted) interconnected by a pin 240.

The side walls 220*a*, 220*b* of the base member 214 are situated between the arms 218*a*, and the indicator 216 is situated between the side walls 220*a*, 220*b*. The pin 240 is slidably and rotatably disposed in identical first slots 242 formed in respective side walls 220*a*, 220*b* and is spring-biased in a direction of bias by tension springs 244 (only one shown), each of which extends between the pin 240 and a fixed joint 246 on the respective side wall 220*a*, 220*b*.

The crank arm 234 of the indicator 216 is pivotably connected to respective ones of the arms 218*a* by respective pin-and-slot connections, and defined by a pin 250 that extends through a second slot 252 formed in the respective side wall 220*a* or 220*b*.

In use, an operator opens the door 206, inserts a new stack of paper towels 202, and re-closes the door. When the door is closed, the arms 218*a* of the release mechanism engage the vertical side 208 of the stack and are pushed to the retracted position shown in FIG. 21, against the bias of the spring 244. Simultaneously, the indicator 216 is swung to a position shown in FIG. 21 wherein the sign 222 is spaced from a window 256 formed in the wall 212. When the stack of towels becomes so depleted that the vertical side 208 of the stack descends to a level below the arms 218*a*, the arms 218*a* are released and swung by the springs 244 to a release position shown in FIG. 18 in a direction causing the sign 222 to be swung toward the window 256 in order to expose the "LOW" indicia as shown in FIG. 20.

Figure 23:
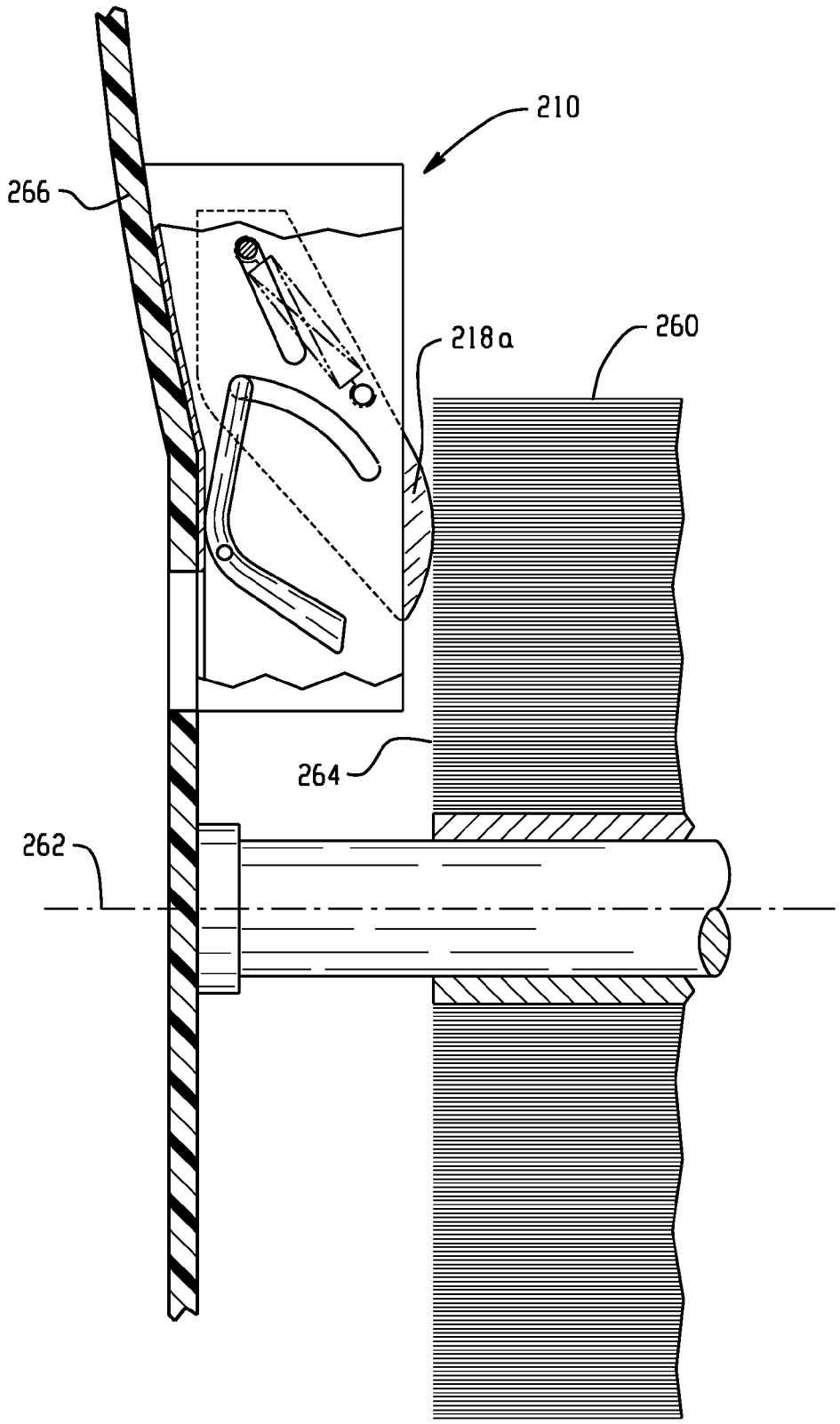
FIG. 23 is a view, similar to FIG. 21, of a dispenser of the type which dispenses towels from a horizontal roll.

The low-reserve indicator mechanism 210 can also be used in connection with a conventional dispenser that dispenses towels from a roll of paper towels 260 which rotates about a horizontal axis 262, as shown in FIG. 23. The towels are separated from the towels 260 by the user, for example, by forcing the paper against a conventional cutter (not shown) formed on the dispenser housing. The paper in the roll has vertically superimposed edge portions that form a vertical side 264 that is contacted by the arms 218*a* of the release mechanism in the manner disclosed above. When the roll is depleted to such an extent that the vertical side 264 descends below the point of contact with the arms 218*a*, the "LOW" indicia of the sign 222 becomes visible outside of the dispenser housing. A wall 266 shown in FIG. 23 could be a side wall of the dispenser housing. The arms 218*a* could be automatically pushed to the retracted position in response to the application of a force thereto from the towels 260 as the roll is being loaded.

The low-reserve indicator is small light-weight, inexpensive and can be automatically placed in a retracted state in response to the loading of paper, or closing the dispenser.

It will also be appreciated that the low-reserve indicator mechanism 210 could assume many different configurations for achieving its intended advantages.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A low reserve indicator mechanism for a supply of paper towels, the mechanism comprising:

a base;

a pushplate connected to the base having a translational degree of freedom therebetween, the pushplate biased in a first direction relative to the base and responsive to a first attribute of the supply of paper towels to translate opposite the first direction; and an indicator pivotally connected to the pushplate, the indicator movable between a retracted position and an indicating position in response to a second attribute of the supply of paper towels.

2. The mechanism of claim 1, further comprising:

a release arm pivotally connected to and biased away from the pushplate, the release arm operably connected to the indicator and responsive to the second attribute to cause the indicator to move between the retracted position and the indicating position.

3. The mechanism of claim 2, wherein the indicator is connected to the release arm via a cam and cam follower.

4. The mechanism of claim 2, wherein the release arm is connected to the indicator by a pin and slot.

5. The mechanism of claim 2, wherein:

the release arm comprises a rib responsive to the second attribute.

6. The mechanism of claim 1, wherein:

the second attribute comprises a predetermined amount of the supply of paper towels; and the indicator is responsive to an amount of the supply of paper towels being reduced below the predetermined amount to move to the indicating position.

7. The mechanism of claim 6, wherein the second attribute is defined by an edge of the supply of paper towels formed by superimposed edge portions of the supply of paper towels.

8. The mechanism of claim 1, wherein the indicator comprises an indicia-carrying sign.

9. The mechanism of claim 1, wherein the supply of paper towels is a roll of paper towels having an exposed inner periphery from which towels are dispensed.

10. The mechanism of claim 9, wherein the second attribute is an edge defined by the inner periphery and superimposed edge portions of the supply of paper towels.

11. The mechanism of claim 9, wherein the first attribute is an outer diameter of the roll of paper towels.

12. The mechanism of claim 11, wherein the pushplate comprises protrusions responsive to the outer diameter of the roll of paper towels to translate the pushplate opposite the first direction.

13. A dispenser for a supply of paper towels, the dispenser comprising:

a housing having a first section movably affixed to a second section, the first section and the second section defining an inner chamber and a dispensing aperture; and a low reserve indicator mechanism comprising:

a base attached to at least one of the first section and the second section;

a pushplate connected to the base having a translational degree of freedom therebetween, the pushplate biased in a first direction relative to the base and responsive to a first attribute of the supply of paper towels to translate opposite the first direction; and an indicator pivotally connected to the pushplate, the indicator movable between a retracted position and an indicating position in response to a second attribute of the supply of paper towels.

14. The dispenser of claim 13, the low reserve indicator further comprising:

a release arm pivotally connected to and biased away from the pushplate, the release arm operably connected to the indicator and responsive to the second attribute to cause the indicator to move between the retracted position and the indicating position.

15. The dispenser of claim 13, wherein at least one of the first section and the second section comprise a guide to position the supply of paper towels within the inner chamber of the housing.

16. The dispenser of claim 15, wherein the second section is fixedly attachable to a wall, and the guide is disposed upon the first section.

17. The dispenser of claim 15, wherein the guide comprises a rib disposed to contact an outer diameter of a roll of paper towels in response to the first section being pivotally closed and affixed onto the second section.

18. The dispenser of claim 13, wherein the dispensing aperture is disposed proximate a center of the housing to dispense the supply of paper towels from an exposed inner periphery of a roll of paper towels.

19. The dispenser of claim 18, wherein the first attribute of the supply of paper towels is an outer diameter of the roll of paper towels.

20. The dispenser of claim 13, wherein:

the second attribute comprises a predetermined amount of the supply of paper towels; and the indicator is responsive to an amount of the supply of paper towels being reduced below the predetermined amount to move to the indicating position.

21. The dispenser of claim 13, wherein:

the second attribute comprises a predetermined amount of the supply of paper towels; and the indicator is responsive to movement of either the first section or the second section toward the other of the first section and the second section and an amount of the supply of paper towels being greater than the predetermined amount to cause the indicator to move to the retracted position.

22. The dispenser of claim 13, wherein the low reserve indicator mechanism is attached to at least one of the first section and the second section such that the indicating position of the indicator, in response to the second attribute of the supply of paper towels, is visible via an exterior of the dispenser.

23. The dispenser of claim 13, wherein:

the base further comprises a first attachment feature;

the housing comprises a second attachment feature disposed within the inner chamber; and the first attachment feature engages the second attachment feature, thereby attaching the base to the housing within the inner chamber.

24. A low reserve indicator mechanism for a supply of paper towels, the mechanism comprising:

a base;

an indicator coupled to the base with a first translational degree of freedom and a first rotational degree of freedom therebetween;

a release arm coupled to the base with a second translational degree of freedom and a second rotational degree of freedom therebetween; and a pushplate coupled to the base with a third translational degree of freedom therebetween;

wherein the first, second and third translational degrees of freedom are coincidental; and wherein the first rotational degree of freedom and the second rotational degree of freedom are coupled such that rotation of the release arm causes rotation of the indicator.

25. The mechanism of claim 24, wherein the coincidental translational degrees of freedom accommodate towel rolls of the supply of paper towels having varying outer diameters independent of the first and second rotational degrees of freedom accommodating an indication of a low supply of the supply of power towels.

* * * * *